US005380244A

United States Patent [19]

Tipton

[11] Patent Number: 5,380,244

[45] Date of Patent: Jan. 10, 1995

[54] SAFETY CABINET

[75] Inventor: Russell C. Tipton, Williamstown, W. Va.

[73] Assignee: Forma Scientific, Inc., Marietta, Ohio

[21] Appl. No.: 67,524

[22] Filed: May 24, 1993

[51] Int. Cl.[6] ..... B08B 15/02

[52] U.S. Cl. ..... 454/57; 55/274

[58] Field of Search ..... 73/706, 714; 454/51, 454/52, 56, 57, 58, 60; 55/274, 285.2, DIG. 34

[56] References Cited

U.S. PATENT DOCUMENTS

| | | | |
|---|---|---|---|
| 3,284,148 | 11/1966 | Ramniceanu . | |
| 3,771,365 | 11/1973 | Schempp | 55/274 X |
| 3,811,250 | 3/1974 | Fowler, Jr. | 454/56 X |
| 3,895,570 | 7/1975 | Eagleson, Jr. . | |
| 3,935,803 | 2/1976 | Bush . | |
| 4,554,830 | 11/1985 | Kitoi | 73/244 |
| 4,557,184 | 12/1985 | Orii et al. . | |
| 4,637,301 | 1/1987 | Shields . | |
| 4,750,922 | 6/1988 | Griffis . | |
| 4,787,922 | 11/1988 | Kulitz . | |
| 4,832,717 | 5/1989 | Peters | 454/56 X |

FOREIGN PATENT DOCUMENTS

| | | | |
|---|---|---|---|
| 3811780 | 10/1989 | Germany | 454/57 |

*Primary Examiner*—Harold Joyce

*Attorney, Agent, or Firm*—Wood, Herron & Evans

[57] ABSTRACT

A safety cabinet having a work area enclosed by a hood structure and including an air circulation and cleaning system. The air circulation and cleaning system includes a plurality of air ducts and passageways through which air is circulated by a blower within the cabinet. A portion of the air exiting the blower is directed through an exhaust after passing through a first filter and the remaining portion of the air exiting the blower is directed through the work area after passing through a second filter. A pressure gauge is connected between the first and second filters for measuring the pressure differential between the two filters to give an indication of the loading and efficiency of the filters. A third filter is disposed upstream of the pressure gauge to remove airborne contaminants in the air flowing to the gauge to prevent such contaminants from leaking from the gauge.

12 Claims, 1 Drawing Sheet

SAFETY CABINET

BACKGROUND OF THE INVENTION

The present invention generally relates to laboratory work enclosures having an isolated work space and more particularly to biological safety cabinets constructed to prevent airborne contaminants within the work space from escaping from the cabinet into the ambient environment.

In the past safety cabinets have been developed for protecting a technician working with various toxic and hazardous materials such as biological matter and radiological materials from exposure to airborne contaminants generated during the handling of these materials. Past work stations have been developed with the object of completely sealing off the work area within the safety cabinet from passage of contaminated air both into the work area and out of the work area into the ambient environment.

The containment or isolation of hazardous and toxic laboratory substances has generally been accomplished by providing a work area which is enclosed or covered with a hood structure having one or more access openings to the work area. The access openings allow a technician, for example, to reach into the work area to handle the material contained in the hood structure. Since these access openings provide another avenue for transfer of hazardous and toxic airborne contaminants between the inside of the hood structure and the outside or ambient environment, it has been a well known past practice to provide a means for causing a continuous, positive air flow into the hood structure through the access opening or openings. This continuous flow of air from the ambient environment through the access opening or openings prevents the escape of any airborne contaminants from the work area.

Many prior safety cabinet structures include high efficiency particulate air (HEPA) filters for filtering air being directed into the work area and air being exhausted from the cabinet into the ambient environment. The air being directed into the work area is drawn both from air recirculated from the work area and air taken in from the ambient environment through the access opening or openings. Thus, the HEPA filter which filters air entering the work area (the "supply filter") ensures that any contaminants picked up from the work area are not recirculated back into the work area and further that contaminants from the ambient air are not circulated through the work area. The HEPA filter which filters air exhausted from the cabinet (the "exhaust filter") ensures that hazardous and toxic airborne contaminants generated by the material contained in the cabinet are not exhausted into the ambient environment. Many other systems requiring very clean air utilize only one HEPA filter which may, for example, simply filter recirculated air within the system.

Whether one or more HEPA filters are used in the system, it has also been generally known to employ one or more static pressure gauges to measure the air pressure across the filters. Where one static pressure gauge is used in a system utilizing two HEPA filters such as the supply and exhaust filters as described above, the pressure differential across the two HEPA filters is measured to obtain information as to the loading of the filters. As the filters become loaded, the resistance to air pressure increases and the reading on the static pressure gauge correspondingly increases. When the reading on the static pressure gauge increases by a given amount, e.g., 50% higher than an original measurement taken with clean filters, the filters usually need replacement due to loading inefficiencies. A similar process for determining the loading of the supply and exhaust filters may be used with two pressure gauges by utilizing each pressure gauge to measure the pressure across a different filter.

Two illustrative examples of safety cabinet structures of the above-mentioned type are found in U.S. Pat. No. 3,895,570 issued to Eagleson, Jr. on Jul. 22, 1975 and U.S. Pat. No. 4,637,301 issued to Shields on Jan. 20, 1987. Each of these patents disclose work stations or safety cabinets of the general type described above having one or more HEPA filters for cleaning air which is circulated through the cabinet structure. The patents to Eagleson and Shields further disclose the use of conventional pressure gauges for measuring the pressure across the HEPA filters.

While past safety cabinets have generally accomplished the goal of preventing airborne contaminants within the cabinet structure from reaching the ambient environment through either the access opening or other seams in the cabinet structure, it has been found through halogen leak testing that airborne contaminants can also leak through the conventional static pressure gauges used in these cabinets. These pressure gauges are exposed to the contaminated air within the cabinet and are not designed to seal airborne particles 0.3 microns or greater in diameter within the cabinet structure as would be required to meet recognized industry safety standards.

SUMMARY OF THE INVENTION

In view of this leakage problem involving conventional pressure gauges used in conjunction with safety cabinets, it is an object of the present invention to prevent egress of hazardous and toxic airborne contaminants from a safety cabinet through pressure gauges used to measure the pressure of contaminated air within the cabinet.

To accomplish this object as well as other objects of the invention, a preferred embodiment of the invention contemplates the employment of filter means for removing airborne particulate contaminants from the air flowing to the static pressure gauge or gauges used in a safety cabinet.

In one preferred embodiment of the present invention the safety cabinet is of the type used in biological applications. One example of a cabinet structure which may be embodied in the present invention is disclosed in a co-pending application, U.S. Ser. No. 07/880,185, filed May 7, 1992 and assigned to the assignee of the present invention. U.S. Ser. No. 07/880,185 is hereby fully incorporated by reference herein.

The cabinet structure is generally comprised of a work area enclosed by a hood. The work area is defined by a ceiling, a floor, and front, rear and side walls of the hood. The front wall includes at least one access opening for allowing a technician to reach the work area. Air passageways are also preferably provided through the ceiling, the floor, and the rear and side walls of the hood to allow air to be circulated through the cabinet in a conventional manner.

A blower means takes in air received from ducts carrying both recirculated air from the work space and air from the outside environment admitted through the access opening of the hood. Exhaust means are also included to vent a portion of the air exiting the blower means to either the environment of the facility containing the cabinet or to the atmosphere through an external exhaust system. The remaining portion of the air exiting the blower means is directed through the air passageways in the ceiling of the hood and passes through the work area and the previously mentioned passageways in the floor and the rear and side walls of the hood for recirculation through the blower means.

Filter means are disposed in the path of the air traveling through the ducts to remove airborne contaminants before the air is either exhausted from the cabinet or directed through the workspace. The filter means preferably include a pair of HEPA filters, one being a supply filter disposed in the path of air being directed into the work area and the other being an exhaust filter disposed in the path of air being directed to the exhaust means.

A control panel is preferably located on an outside front surface of the cabinet and includes switches which, for example, operate the blower and conventional fluorescent lights, ultra-violet lights and electrical receptacles contained in the work area. At least one static pressure gauge is also preferably located on the control panel for measuring the pressure differential across the supply and exhaust filters. This pressure gauge provides an indication of filter "loading" by showing an increased static pressure when the resistance to air passage through the filter increases. In a preferred embodiment of the invention, a single pressure gauge is operably connected to the cabinet to take a reading of the pressure between the supply and exhaust filters. Thus, the air flowing to the pressure gauge includes contaminated air from the work area which has not yet passed through either the supply filter or exhaust filter.

To remove airborne contaminants from the air flowing to the static pressure gauge, another filter means, which is preferably a third HEPA filter, is provided in this flow path. in the preferred embodiment of the invention an air line having an in-line HEPA filter is connected between the supply filter plenum and the pressure gauge. Thus, harmful airborne contaminants are removed from the air flowing to the pressure gauge before they can leak out of the pressure gauge into the environment.

Further objects and advantages of the invention will become readily apparent to those of ordinary skill from the following detailed description taken in conjunction with the accompanying drawings.

DETAILED DESCRIPTION OF THE PREFERRED EMBODIMENT

Figure 2:
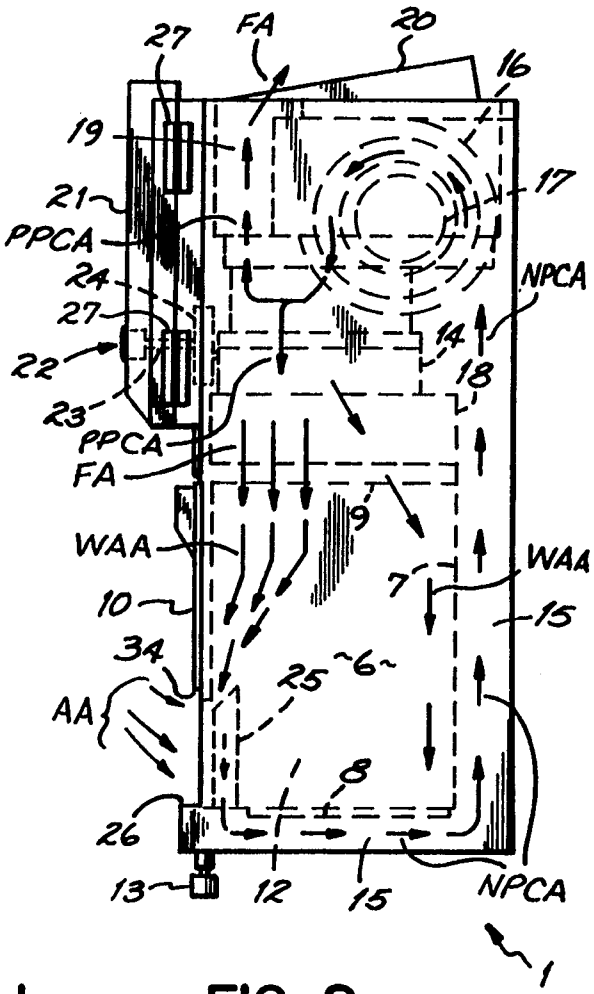
FIG. 2 is a side plan view of the cabinet of FIG. 1.
Figure 1:
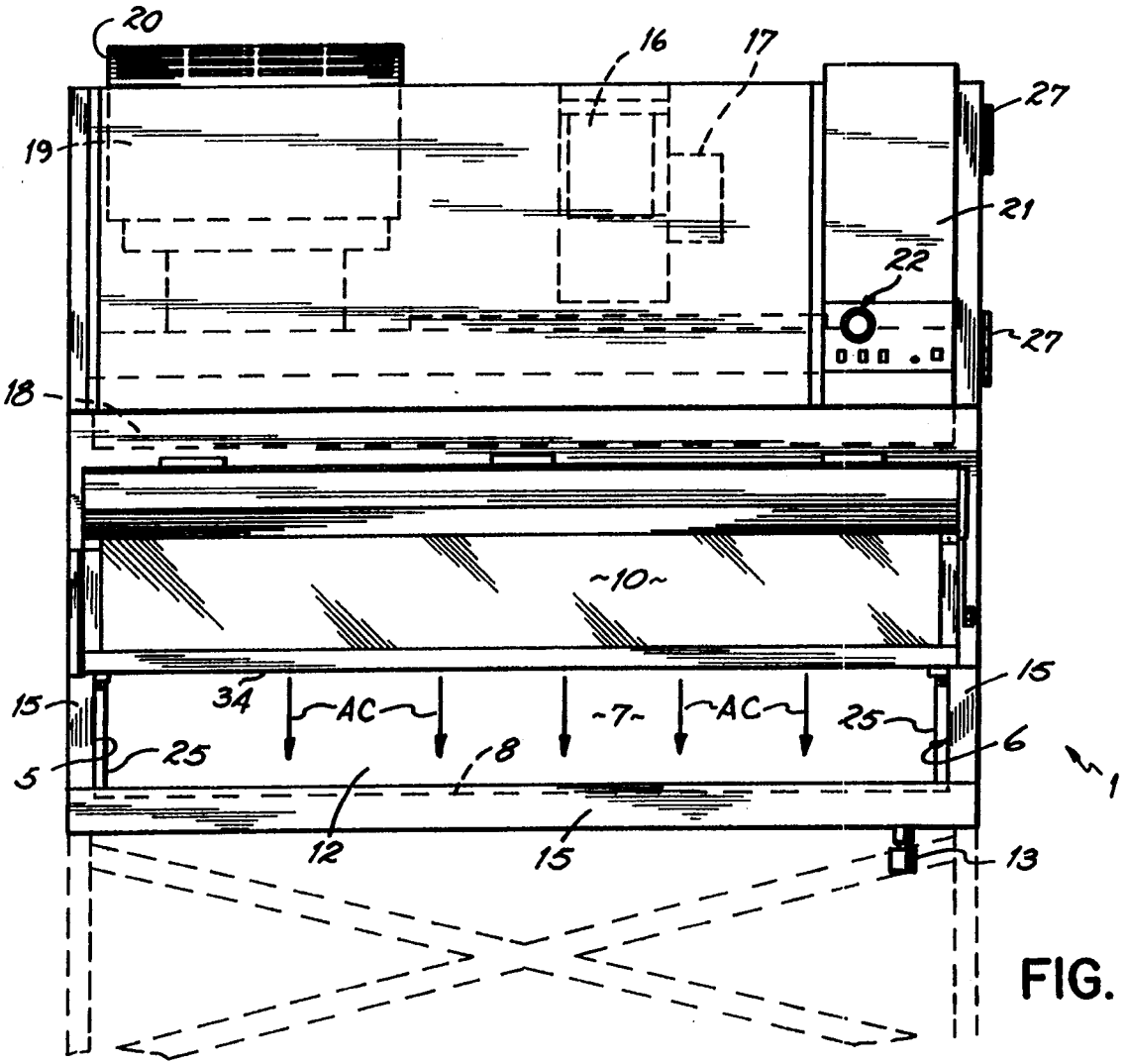
FIG. 1 is a front plan view of the biological safety cabinet of the present invention.

FIGS. 1 and 2 illustrate one preferred embodiment of the biological safety cabinet 1 of the present invention. The cabinet includes two side walls 5, 6, a rear wall 7, a bottom wall 8 defining a work surface, an air diffuser forming a top wall 9 and a front window 10. The side walls 5, 6, rear wall 7, bottom wall 8, top wall 9 and front window 10 define a work area 12. A negative pressure plenum 15 surrounds the side walls 5, 6, rear wall 7 and bottom wall 8 of the cabinet 1. A conventional drain valve 13 is mounted to the cabinet 1 to drain fluids from the floor or bottom wall 8 of the work area 12. A blower 16 powered by a motor 17 creates negative pressure within the plenum 15 and forces air through a supply filter 18, which is preferably a high efficiency particulate air (HEPA) filter, located above the air diffuser or top wall 9. An exhaust filter 19 is provided at the top of the cabinet 1 along with an exhaust filter guard 20. The exhaust filter 19 is also preferably a HEPA filter.

A control box 21 is provided on the front of the cabinet 1 for containing the necessary electrical controls for operating the cabinet 1 and particularly the blower motor 17. On the front panel of the control box 21, a static pressure gauge 22 is provided for measuring the pressure differential across the filters within the cabinet 1 as explained in detail below. The control box 21 is hinged as shown at 27 to allow access to the cabinet control components within the control box 21 for maintenance, repair or other purposes.

FIG. 2 specifically illustrates the flow pattern of air within the safety cabinet 1. When the cabinet power is activated, such as by a switch on the control box 21, the blower motor 17 and blower 16 are likewise activated. The blower draws ambient air AA into channel sections 25 as well as threshold 26 of the cabinet 1 and ultimately into the negative pressure plenum 15. Negative pressure created by the blower 16 draws this ambient air AA as well as contaminated air from the work area 12 through the negative pressure plenum 15 upwardly to the blower 16. This mixture of ambient air AA and contaminated air from, the work area 12 is represented as negative pressure contaminated air NPCA traveling within the negative pressure plenum 15 as shown in FIG. 2.

After the negative pressure contaminated air NPCA has passed through the blower 16, it becomes positive pressure contaminated air PPCA. A portion of the positive pressure contaminated air, e.g., approximately 40% thereof, travels upwardly through the exhaust filter 19 and the remaining portion travels downwardly through the supply filter 18. Filtered air FA passes downwardly into the work area 12 as work area air WAA where it becomes contaminated from the products internal to the work area 12. The work area air WAA is drawn into the plenum 15 through slots (not shown) in the side walls 5, 6 and the rear wall 7, through threshold 26 and through channel sections 25, the operation of which is fully described in the above-mentioned co-pending application, U.S. Ser. No. 07/880,185. A detailed description of these aspects of the preferred embodiment of the invention will not be given as they do not form a part of the inventive aspects of the presently claimed invention.

As shown in FIG. 1, the circulation of work area air WAA downwardly through the work area 12 and past the lower edge 34 of the window 10 creates an air curtain AC between the lower edge 34 of the window 10 and the threshold 26 of the cabinet 1, which has an air intake grill (not shown) thereon. The air intake grill communicates with the plenum 15, and when a negative pressure is created within the plenum 15 by the blower 16, the work area air making up the air curtain AC travels downwardly from the lower edge 34 of the window 10 to the intake grill. This clean filtered air FA descends uniformly through the work area, for example, at a rate of about 60–80 linear feet per minute.

As previously mentioned, the front panel of the control box includes a static pressure gauge 22 for measuring the pressure differential across the supply filter 18 and exhaust filter 19. The space between the supply filter 18 and the exhaust filter 19, i.e., the positive pressure plenum 14, contains contaminated air which has been recirculated from the work area 12 and drawn in from the ambient environment. Therefore, the air reaching the static pressure gauge 22 under positive pressure has, in past safety cabinet structures, also been contaminated air. The purpose of the static pressure gauge 22 is to give an indication to the operator of the loading of the supply and exhaust filters 18, 19. As the filters 18, 19 become loaded, the resistance to air passage increases and the reading on the static pressure gauge increases accordingly. When the reading on the static pressure gauge 22 increases by a predetermined amount, (e.g., 50% higher than an original measurement taken with new filters), this is an indication that the cabinet airflow should be checked with a thermoanemometer. The filters 18, 19 are then replaced if the filter pressure and flow rate exceed the blower capacity.

The static pressure gauge 22 is preferably a conventional Magnehelic® gauge having, for example, two high pressure ports. In the preferred embodiment of the present invention one of these high pressure ports (not shown) is "capped" or sealed and the other port is connected to a pressure line 23 leading to the positive pressure plenum 14. Filter means 24 is connected to the line 23 within the cabinet 1 such that the positive pressure contaminated air PPCA exiting the blower 16 does not reach the pressure gauge 22 without first passing through the filter means 24. This filter means 24, like the supply and exhaust filters 18 and 19, is preferably a HEPA filter installed in the line 23 leading to the static pressure gauge 22. One filter suitable for use in the present invention is manufactured by Gelman Sciences, Inc. and is sold under part number 601-4270 DISPOSABLE FILTER 99.97. This is a glass micron filter having a 0.2 micron or 200 nanometer pore size.

It will be appreciated that the present invention is adapted for use in systems having any number of filters wherein one or more static pressure gauges are used to measure the pressure across the filter or the pressure differential across multiple filters. In any of these systems the present invention prevents contaminated air from leaking from the static pressure gauge or gauges in the system by assuring that any air that does leak from these gauges is filtered air which has previously passed through an appropriate filter means such as a HEPA filter.

Although a preferred embodiment of the present invention has been shown and described in detail, many modifications and adaptations of the invention will be readily apparent to those of ordinary skill in the art and applicant intends only to be bound by the claims appended hereto.

What is claimed is:

1. In a safety cabinet having a work area defined within said cabinet, means for directing air through said work area, first filter means disposed upstream of said work area for removing airborne contaminants from air directed into said work area, and pressure gauge means for measuring static pressure across said first filter means, the improvement comprises:

second filter means operatively connected to said pressure gauge means for removing hazardous and toxic airborne contaminants from air flowing to said pressure gauge means and thereby preventing escape of said hazardous and toxic airborne contaminants from said cabinet through said gauge means.

2. The safety cabinet of claim 1 wherein said pressure gauge means includes input port means operatively connected upstream of said first filter means by an air line, said air line further including said second filter means.

3. The safety cabinet of claim 2 wherein said first and second filter means each comprise a high efficiency particulate air filter.

4. The safety cabinet of claim 3 further comprising an exhaust means for exhausting air from said cabinet shell and a third high efficiency particulate air filter disposed upstream of said exhaust means, wherein said air line is operatively connected between said first and third filter means.

5. The apparatus of claim 1 wherein said second filter means is a high efficiency particulate air filter.

6. A biological safety cabinet apparatus comprising:

a cabinet shell having an interior work area and means for circulating air through said work area, a first filter disposed upstream of said work area for removing airborne contaminants from air entering said work area;

a gauge for measuring static pressure across said first filter, and a second filter operatively connected to said gauge for removing hazardous and toxic airborne contaminants from air flowing to said gauge and thereby preventing escape of said hazardous and toxic airborne contaminants from said cabinet through said gauge means.

7. The apparatus of claim 6 further comprising an exhaust for exhausting air from said cabinet shell.

8. The apparatus of claim 7 further comprising:

a third filter disposed upstream of said exhaust for removing airborne contaminants from air entering said exhaust.

9. The apparatus of claim 8 wherein said gauge is operatively connected between said first and third filter means for measuring the pressure differential across said first and third filter.

10. The apparatus of claim 9 wherein said second filter is disposed in an air line connected between said gauge and said first and third filter.

11. The apparatus of claim 10 wherein said first, second and third filters each comprise a high efficiency particulate air filter.

12. The apparatus of claim 6 wherein said second filter is a high efficiency particulate air filter.

* * * * *